US005284261A

United States Patent [19]

Zambuto

[11] Patent Number: 5,284,261

[45] Date of Patent: Feb. 8, 1994

[54] BABY BOTTLE AIR VENT

[76] Inventor: Sam C. Zambuto, 4744 W. Las Palmaritas, Glendale, Ariz. 85302

[21] Appl. No.: 915,288

[22] Filed: Jul. 20, 1992

[51] Int. Cl.[5] ..... A61J 11/02

[52] U.S. Cl. ..... 215/11.5; 220/304; 220/367; 220/374

[58] Field of Search ..... 215/11.5, 11.6, 309; 220/374, 373, 367, 366, 304

[56] References Cited

U.S. PATENT DOCUMENTS

| | | | |
|---|---|---|---|
| 2,493,380 | 1/1950 | Bailey | 215/11.5 |
| 2,525,745 | 10/1950 | Wycoff | 215/11.5 |
| 2,557,917 | 6/1951 | Schlesinger | 222/490 |
| 2,762,520 | 9/1956 | Kurkjian | 215/11.5 |
| 2,811,270 | 10/1957 | Kurkjian | 215/11.5 |
| 3,059,797 | 10/1962 | Wilkinson et al. . | |
| 3,481,500 | 12/1969 | Palma | 215/11.5 |
| 3,722,728 | 3/1973 | Yazaki | 215/11.5 |
| 3,770,154 | 11/1973 | Johnson | 215/11.5 |
| 4,094,437 | 6/1978 | Hayashida | 220/374 |
| 4,488,551 | 12/1984 | Connelly | 215/11.5 X |
| 4,646,945 | 3/1987 | Steiner et al. | 222/490 X |

*Primary Examiner*—Allan N. Shoap
*Assistant Examiner*—Christopher McDonald
*Attorney, Agent, or Firm*—James F. Duffy

[57] ABSTRACT

An insert for a nursing bottle is disclosed. It is placed between the bottle and the nipple. The insert has a channel that communicates with the air passage holes in the nipple. The channel itself has air passage holes that are sized to allow air into the bottle but prevent the liquid in the bottle from exiting. This arrangement prevents the creation of a vacumn in the bottle when the liquid exits through the nipple.

5 Claims, 1 Drawing Sheet

BABY BOTTLE AIR VENT

BACKGROUND

1. Field of the Invention

The invention relates to nursing implements from which an infant or other suckling animal takes sustenance. In particular, the invention relates to improvements in such implementation so as to permit the ready flow of air into the nursing container as liquid is drawn therefrom by an infant or suckling animal.

2. Prior Art

When an infant or animal suckles at a bottle to draw liquid therefrom through a nipple, the withdrawal of liquid produces a partial vacuum within the nursing bottle. As the vacuum builds up within the nursing bottle, it becomes extremely difficult for the suckling to draw liquid from the bottle.

This phenomenon is well known to parents of infants that draw sustenance by nursing at a baby bottle. As the baby nurses and draws liquid from the bottle, the partial vacuum is created and the nipple collapses because of the differential air pressure within and without the bottle. When the nipple is removed from the infant's mouth and the bottle rotated to an upright position, a squeal of air entering the bottle through the nipple can be heard. This squeal is often thought to be created by air entering the small opening in the nipple through which liquid is drawn. In fact, once the nipple has collapsed, very little, if any, air can be drawn into the nursing bottle through the nursing opening in the nipple. Rather, the manufacturers of nursing nipples have provided one or more fine holes in the base of the nipple through which air enters into the nursing bottle.

These air vent openings, the fine holes at the base of the nipple, are so narrow in diameter they appear to have been made by puncturing the nipple base with a needle. While they function well to permit air to flow into the bottle, while the bottle is in an upright position, they seldom function as an air vent when liquid within the bottle covers these openings, as is the case when the baby is nursing.

If the air venting holes at the base of the nipple are enlarged, air will vent there through while the baby is nursing. However, the manipulation of the nipple by the sucking action of the child causes liquid to be expelled through these enlarged openings in the base of the nipple and the overall functioning of the nursing system is significantly degraded.

Because a simple enlargement of the air vent openings in the base of the nipple proves unsatisfactory in practice, many persons skilled in the prior art have thought to incorporate check valves at the base of the nursing bottle or other nursing liquid container. Unfortunately, check valves eventually provide a source of contamination of the liquids placed within the bottle.

It is an object of the present invention to provide air venting of a nursing liquid container in a manner which utilizes the existing fine venting holes in the base of the nipple already provided by the nipple manufacturer. It is the intent of the present invention to provide means whereby liquid within the container does not come in contact with these fine vent openings in the nipple while the nipple is being suckled, yet air enters through these fine openings to bubble through the liquid and prevent the build up of a partial vacuum within the nursing container.

SUMMARY OF THE INVENTION

The invention may be seen as an improvement in means for feeding a suckling. The prior art means to be improved comprises a container for liquid to be fed to a suckling and a nipple which is coupled to the container to be suckled by coupling means which positions the nipple over an opening in the container. The nipple has an opening itself through which liquid is drawn from the container by a suckling. The nipple also has air vent openings for allowing the passage of air into the container as liquid is drawn from the container. These air vent openings are small enough to prevent liquid leaking through them as the nipple is manipulated by a suckling feeding at the nipple. However, the same air vent openings are generally ineffective in venting the container while a suckling is actually feeding. The improvement is intended to overcome this ineffective vent.

The improvement comprises an air reservoir means which is coupled to the nipple and to the container. The air reservoir receives air and ambient pressure from the air vent openings in the nipple. An air passage is provided to couple air from the air reservoir to the container as liquid within the container was withdrawn by a suckling feeding at the nipple. This air passage has a cross sectional area which is small enough to inhibit entry of liquid from the container into the air reservoir and yet is large enough to permit the free passage of air from the air reservoir through the liquid into the container as the liquid is being withdrawn from the container by a suckling.

In a presently preferred embodiment of the invention, the container is a baby nursing bottle which has an opening to which the nipple is coupled. The improvement further comprises an air reservoir insert which is insertable into the opening in the baby nursing bottle. The air reservoir insert is interposed between the nipple and the bottle. The insert has egress means through which liquid in the bottle flows to the nipple. The air reservoir means is part of the air reservoir insert.

In this embodiment of the invention, the air reservoir insert comprises an annulus which has a lip about its periphery. The lip is employed for engaging with the opening of the nursing bottle. The annulus has a surface with a groove in it. The groove lies adjacent the air vent opening in the nipple when the insert is in the neck of the bottle and the nipple is coupled to the bottle. This groove constitutes the air reservoir means.

The invention may be conceived in a more limited aspect as an improvement to a nursing bottle, the bottle having a necked opening with threads for engaging a threaded closure cap. There is a nipple which has an extended base for making coupling contact with the necked opening of the nursing bottle. This extended base includes an air vent opening for allowing air to enter into the nursing bottle when liquid within the bottle is drawn off through the nipple. The threaded closure cap has a central opening through which the nipple is passed and a shoulder of the threaded closure cap compressively couples the extended base of the nipple to the bottle at the necked opening of the bottle.

In this instance, the actual improvement consists of a nursing bottle venting insert. The venting insert is inserted within the necked opening and is compressively coupled to the bottle between the extended base of the nipple and the necked opening of the bottle. The venting insert has means for inhibiting liquid from the bottle from contacting the air vent openings in the extended base of the nipple when liquid is drawn off through the nipple. The venting insert permits air to enter the bottle through these air vent openings. As in the earlier described embodiments, the means for inhibiting the liquid from contacting the air vent opening comprises an air reservoir into which air from the air vent opening flows as liquid is drawn off from the bottle through the nipple There is an air passage coupling the air reservoir to the interior of the bottle; and, once again, the air passage has a cross sectional area which is small enough to inhibit entry of liquid from the bottle into the air reservoir and large enough to permit the free passage of air from the reservoir through the liquid into the bottle as liquid is being withdrawn from the bottle by sucking action at the nipple The invention may also be described simply in terms of apparatus. The apparatus is an air venting insert used to prevent vacuum buildup within a nursing bottle. The air venting insert comprises an annular insert, sized and configured to be inserted and maintained in the neck of a nursing bottle. There is an air reservoir within the insert for receiving air from a vent opening in a nipple used with a nursing bottle. There is also an air passageway within the insert to couple air from the air reservoir to the interior of the bottle. As before, the air passage as a cross sectional area small enough to inhibit entry of liquid from the bottle into the reservoir and large enough to permit free passage of air from the reservoir through the liquid and into the bottle.

The invention teaches the methodology for improving the venting action of an air vent opening in a nursing nipple, which nipple is used with a container that has liquid which will be drawn from the container through the nipple. The method includes the steps of coupling an air reservoir to an air opening in a nursing nipple. An air passage is then provided between the air reservoir and the interior of the container on which the nipple is used. The method requires that the interior of the air reservoir be isolated from entry by liquid from the container. This isolation is achieved by making the cross sectional area of the air passageway small enough to inhibit passage of liquid there through and yet large enough to permit air to pass from the reservoir through the liquid and into the container.

In practicing the methodology, a product for improving the venting action of air vent openings in a nursing nipple will be produced. This product produced by practice of the process has been claimed herein.

The invention may be verbally depicted as the combination of a nursing bottle, a nipple, a vacuum inhibitor and, means for securing the nipple and the inhibitor to the bottle. The nipple has a circular flange provided with a nipple vent opening. The nipple vent opening is sufficiently large for passage of air into the bottle when clear of any liquid contained in the bottle and sufficiently small to block passage of both air and of liquid when liquid in the bottle covers the nipple vent opening.

The circular flange has a central opening for passage of liquid to the nipple from the nursing bottle. The flange has a first contact surface about the periphery of the central opening and a second contact surface about the periphery of the flange.

The nursing bottle has a circular neck defining a central opening through which liquid can pass to and from the bottle. The neck has a peripheral surface to which the second contact surface of the circular flange of the nipple is nominally coupled.

The vacuum inhibitor comprises a generally planar circular disk having a first disk surface and a second disk surface. There is a central opening for passage of liquid therethrough. The first disk surface has a third contact surface about the periphery of the central opening of the disk and a fourth contact surface about the periphery of the disk. The first disk surface also has a recess therein between the third and the fourth contact surfaces. The recess has a disk vent opening therein through the disk. The disk vent opening is sufficiently small to block passage of liquid therethrough and sufficiently large to permit passage of air therethrough even when covered by liquid.

The means for securing the nipple and the inhibitor to the bottle comprises means for compressively coupling the circular flange of the nipple and the circular disk of the inhibitor to the circular neck of the bottle so that the central openings of the flange, the disk, and the neck of the bottle are generally concentric.

The combination itself comprises the disk of the inhibitor placed on the bottle with the second disk surface in contact with the peripheral surface of the neck of the bottle. The nipple is placed on the disk of the inhibitor with the first contact surface of the flange being in contact with the third contact surface of the disk. The second contact surface of the flange is in contact with the fourth contact surface of the disk. A portion of the flange covers the recess in the disk. The vent opening in the flange communicates air to the recess. Finally, the means for securing the nipple and the inhibitor compressively couples the nipple and the inhibitor to the neck of the bottle.

DESCRIPTION OF THE DRAWINGS

FIG. 3 is a detailed section of the prior art assembly of FIG. 2 illustrating the manner in which air is intended to vent into a nursing bottle through small openings in the extended base of the nipple.

FIG. 4 is prior art similar to the illustration of FIG. 3, however, liquid within the bottle covering the small vented opening creates a force great enough to inhibit passage of exterior air through the small vented opening in the base of the nipple.

FIG. 5 is a cross sectional view of the airway vent insert of the invention showing the air reservoir and the air passageway which couples the air reservoir to the interior of the nursing bottle.

FIG. 6 is similar to the drawing of FIG. 4 with the exception that the innovative air vent insert has been inserted within the neck of the nursing bottle prior to the assembly of the prior art nipple and cap on the bottle. The path of air entering the bottle and bubbling through the liquid therein is illustrated.

A DETAILED DESCRIPTION OF THE INVENTION

Figure 1:
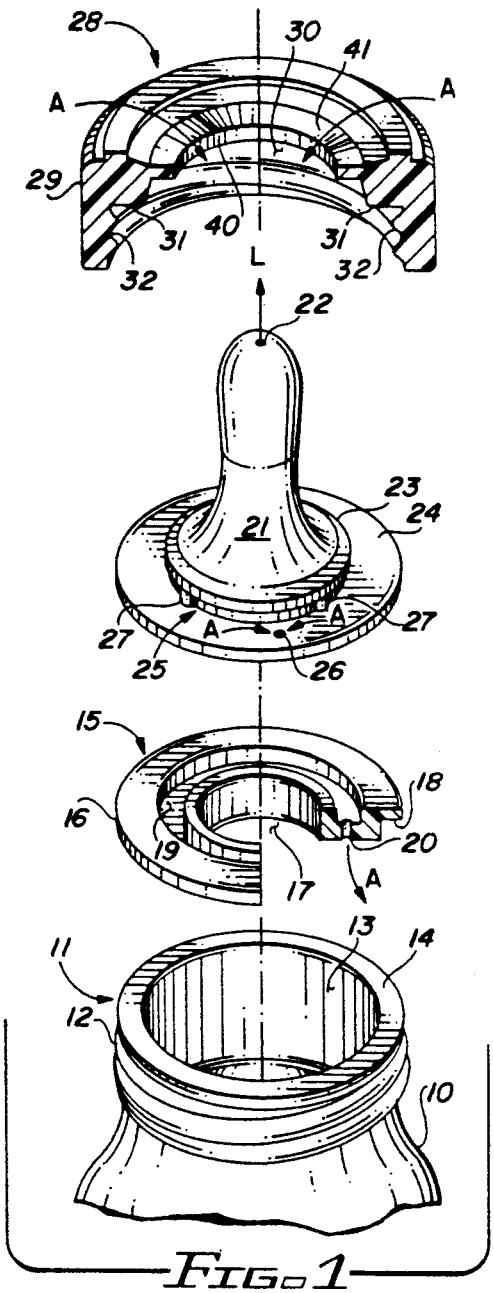
FIG. 1 is an exploded assembly drawing illustrating the manner in which the air reservoir insert of the invention is utilized with a prior art nursing bottle and nipple.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

There will be a general familiarity with the elements of the exploded assembly drawing of FIG. 1 for anyone who has ever prepared a baby's nursing bottle. The baby bottle 10 has a necked opening 13 which provides ingress and egress means for liquids. The neck 11 has external threads 12 which mate with the interior threads 32 of threaded closure cap 28 at the top of the illustration. Cap 28 is comprised of an annulus 29 having interior threads 32 and a central opening 30. A nipple 21 is provided with an opening 22 through which a liquid L is drawn by the nursing of an infant or small animal at nipple 21.

Nipple 21 has an extended base 24 which, in the prior art, rests on the lip 14 of necked opening 13 of bottle 10. Immediately above the extended base 24 is an annular reinforcing ring 23. A recess 25 is defined in nipple 21 in the area between the reinforcing ring 23 and extended base 24. Recess 25 will form part of a pathway through which air may pass in entering bottle 10 when nipple 21 and closure cap 28 are assembled to the neck 11 of bottle 10.

Within recess 25 of nipple 21, three or four standoff abutments 27 are equally spaced about the periphery of recess 25. Standoff abutments maintain the position of nipple 21 within the central opening 30 of closure cap 28. Standoff abutments 27 come in contact with the inner wall 40 of cap 28 and maintain the nipple 21 centrally positioned within the opening 30 of cap 28.

In assembling the prior art nursing system, nipple 21 is passed upwardly through the central opening 30 of cap 28. The extended base 24 of nipple 21 is positioned and maintained in intimate coupling contact with shoulder 31 of cap 28. Reinforcing ring 23 is distorted to pass through opening 30 of cap 28 and is positioned above the sloping surface 41 of cap 28. When cap 28, nipple 21 and baby bottle 10 are assembled, as required by the prior art, the assembly is that shown in the partial cross sectional view of FIG. 2. The extended base 24 of nipple 21 is compressively captivated between the lip 14 of bottle 10 and the shoulder 31 of cap 28. The recess 25 constitutes a partial void between the wall 40 of cap 28 and nipple 21. This void is only partial because standoff abutments 27 will make contact with the inner wall 40 of closure cap 28.

Figure 2:
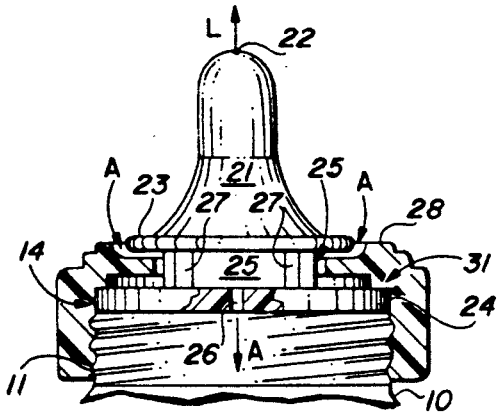
FIG. 2 (PRIOR ART)
FIG. 2 is a cross sectional view of the prior art assembly of a nipple to a nursing bottle.

An air vent opening 26, seen in FIG. 1 in the extended base 24 of nipple 21, is shown in cross section in FIG. 2. Air flow, indicated by the arrows A, passes down the sloping sides 41 of cap 28 into recess 25 between reinforcing ring 23 and extended base 24 of nipple 21 and passes through air vent 26 to the interior of bottle 11. This air flow concept is shown more clearly in the detail of FIG. 3. It should be noted that in FIGS. 3 through 6 the referenced elements depicted are inverted from their illustrations shown in FIGS. 1 and 2. FIGS. 3 through 6 illustrate the positions the elements assume when the baby bottle 10 is inverted so that an infant or small animal may suckle at nipple 21.

Figure 3:
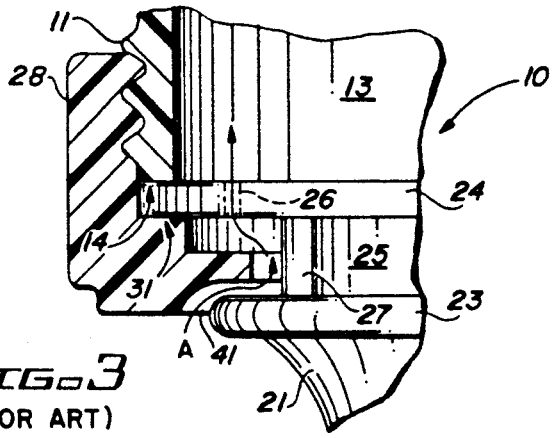
FIG. 3 (PRIOR ART)
FIGS. 3 through 6 illustrate the elements of the nursing system oriented in the manner in which an infant or suckling animal would suckle at the nipple. These figures have their elements inverted with respect to the elements illustrated in FIGS. 1 and 2.

In the detail of FIG. 3, the prior art assembly shows the extended base 24 of nipple 21 compressively captivated between bottle lip 14 and the shoulder 31 of closure cap 28. Air flow A is shown passing between cap 28 and reinforcing ring 23 into recess 25 and then through air vent opening 26 into the necked opening 13 of bottle 10.

Figure 4:
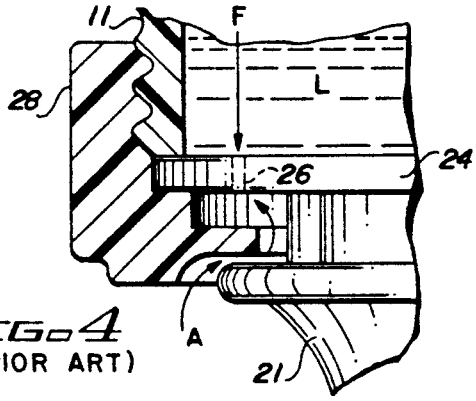
FIG. 4 (PRIOR ART)

In the illustration of FIG. 3, no liquid is indicated as being present within bottle 10. Air flow A is thus unimpeded through air vent opening 26 into the interior of bottle 10. The illustration of FIG. 4 presents a different situation. In FIG. 4, liquid L is present within bottle 10. The liquid covers over air vent 26 in the extended base 24 of nipple 21. Depending upon the density of the liquid L and the depth of the liquid within bottle 10, a force F is presented by liquid L at the opening of air vent 26. It is the inventor's belief that this force F exerted by liquid L at the opening of air vent 26 is responsible for the general failure of prior art nursing systems to properly vent the nursing bottle as an infant or animal nurses on the nipple.

Persons who have bottle fed a baby will recognize that the baby readily draws liquid from the bottle as nursing begins. However, as liquid is drawn from the bottle, the baby struggles to continue drawing further nourishment. A partial vacuum is created within the bottle. The nipple collapses and flattens out and soon no nourishment is being taken by the child. When the nipple is removed from the child's mouth and the bottle placed in an upright position, a high-pitched squeal is heard as air trickles back into the bottle through air vent openings 26. It is the inventor's belief that the air vent openings 26 in commercially available nipples have such a small cross sectional area that they are incapable of functioning as air vents when liquid within the bottle covers the air vent openings.

The inventor has experimented and increased the diameter of air vent openings 26 over and above the diameter presently found in commercially available nipples. With a larger diameter opening, air will vent through the enlarged opening and trickle upward through the liquid within the bottle. However, increasing the cross sectional area of air vent 26 introduces a problem in the nursing function of the system. As the child suckles at the nipple manipulating and distorting it, milk dribbles through the enlarged opening. This makes the task of feeding the infant both inefficient and messy.

Whether liquid will flow from a container into the outside ambient environment depends upon the cross sectional area of the opening through which the liquid must flow. The ambient air pressure of 15 pounds per square inch, approximately, must be overcome before liquid can flow through an opening from a container. Magicians have delighted small groups of people for years by up-ending a soda bottle filled with water and having no water pass through the apparently unimpeded opening at the neck of the bottle. In fact, the Magician has deceptively applied a clear plastic cap to the soda bottle opening. The plastic cap has an opening in it approximately the size of a pencil. Because the opening of the bottle has been reduced to pencil size, the air pressure exterior of the bottle prevents the liquid within the bottle from draining therefrom. Yet, to the delight and mystification of the audience the Magician can take a pencil and pass it upward into the bottle with little or no water exiting the bottle. Thus, for all appearances, the bottle has its opening unimpeded; yet, liquid is retained.

The inventor reasoned that if the liquid could be inhibited from making intimate contact with the small diameter of the air vent 26 provided with commercial nipples, the air venting function could be efficiently achieved while the infant was nursing. To this end, the inventor has conceived of the air reservoir insert 15 shown in FIG. 1.

In the discussion of FIG. 1, to this time, no mention has been made of air reservoir insert 15. The remaining elements of the exploded assembly, bottle 10, nipple 21 and closure cap 28, are all part of the prior art system. It is the intent of the inventor to utilize these prior art elements unchanged so that manufacturing procedures need not be modified.

Reservoir insert 15 is comprised of an annulus 16 which has a central opening 17 through which liquids may pass from bottle 10 into nipple 21. An annular groove 19 provides an air reservoir means to be coupled to air vent 26 in the extended base 24 of nipple 21. An air passageway 20 communicates air from the air reservoir means 19 to the interior of bottle 10. In use, reservoir insert 15 is inserted into the necked opening 13 of bottle 10. A lip 18 at the periphery of annulus 16 supports the insert 15 and prevents it from slipping into bottle 10.

Figure 5:
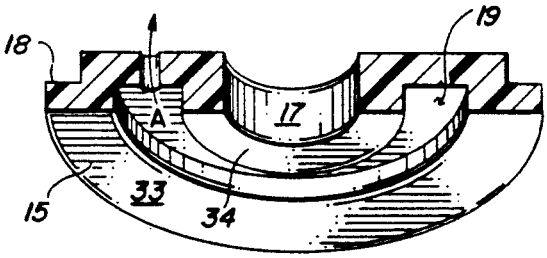

An enlarged cross sectional view of air reservoir insert 15 is shown in FIG. 5. Lip 18 at the periphery of insert 15 is positioned in intimate contact with the lip 14 of neck opening 13 of bottle 10. See FIG. 6. The surface 33 of insert 15 is placed into intimate contact with the periphery of extended base 24 of nipple 21. When closure cap 28 is thread coupled to the neck 11 of bottle 10, interior shoulder 31 compressively couples the periphery of extended base 24 and insert lip 18 with bottle lip 14.

Figure 6:
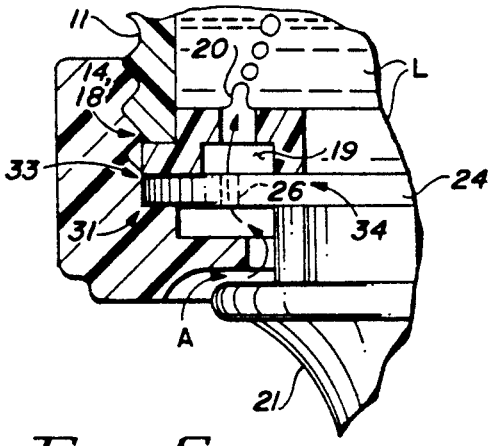

Surface 34 of insert 15 is in intimate contact with an annular section of extended base 24 closer to the central axis, not shown, of nipple 21. Between the surfaces 33 and 34 of insert 15 air reservoir means 19 is defined. In assembling the nipple 21, cap 28 and insert 15 to bottle 10, as indicated in the detail of FIG. 6, air reservoir 19 is coupled to air vent opening 26 in the extended base 24 of nipple 21. Air flow A from the exterior of the assembly through air vent opening 26 into air reservoir 19 maintains air reservoir 19, as well as air passageway 20, at the ambient pressure exterior of bottle 10.

Air passage 20 permits air to flow from air reservoir 19 into liquid L as illustrated in FIG. 6. The cross sectional area of air passage 20 is small enough such that liquid L will not flow through passageway 20 and into air reservoir 19. Conversely, air passage 20 has a large enough cross sectional area to permit air to flow freely from air reservoir 19 when air passage 20 is covered with liquid L as illustrated in FIG. 6, which is the situation which exists when a child or a small animal nurses at nipple 21.

Thus, a simple insert 15 having an air reservoir 19 in communication with air vent opening 26 in a commercially available nipple 21 permits air to flow readily through the air vent opening 26 into reservoir 19 and thence through a passageway 20 communicating reservoir 19 with the interior of nursing bottle 10. The insert 15 is readily cleaned and sterilized. There are no moving parts to become clogged and inoperative. Air passage 20 is easily cleaned using a small brush or pipe cleaner.

Those skilled in the art will recognize that the annular air reservoir 19 can be eliminated if air passage 20 is located adjacent air vent opening 26 in nipple base 24. In this case, air passage 20 serves as both air reservoir and air passageway. However, use of a large annular shaped air reservoir avoids any problems of alignment of air vent openings 26 with air passage 20, such as would otherwise arise.

What has been described is an air reservoir insert for insertion in the neck of a nursing bottle. The insert has an air reservoir which is placed in close juxtaposition with air vent openings at the base of a commercially available nipple. Air flows through these air vent openings in the nipple and into the air reservoir in the insert. An air passage communicates air from the air reservoir in the insert into the interior of a nursing bottle. The air passageway opening has a cross sectional area which is small enough to prevent liquid within the bottle from entering into the air reservoir. Conversely, the opening of the air passageway is large enough to permit air to readily exit from the air reservoir and pass through the liquid within the bottle to prevent the formation of a partial vacuum within the bottle when the nipple is being suckled.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. In means for feeding a suckling comprising a container for a liquid to be fed to a suckling, a nipple coupled to said container, said nipple to be suckled, and coupling means for coupling said nipple to said container; said nipple having a central opening adjacent said container through which liquid enters said nipple from said container, an opening through which liquid is drawn from said container by said suckling, and an air vent opening for allowing the passage free of vent values and of air into said container; said air vent opening being small enough to prevent liquid leaking therethrough as said nipple is manipulated by a suckling feeding at the nipple, and, further said air vent opening being generally ineffective in venting said container while a suckling is feeding; the improvement comprising:

an insert cooperating with said coupling means to be coupled to said container with said nipple, said insert having:

a liquid entry opening adjacent said central opening of said nipple;

a first surface coupled to said nipple adjacent said central opening of said nipple and permitting unimpeded passage of air through said air vent opening in said nipple;

a second surface coupled to said nipple where said nipple is coupled to said container, said second surface permitting free passage of air through said air vent opening in said nipple;

a region between said first surface and said second surface of said insert, said region defining an air reservoir means coupled to said nipple and said container, said reservoir receiving air at ambient pressure from said air vent opening; and an air passage coupling air from said air reservoir to said container as liquid within said container is withdrawn by a suckling feeding at said nipple, said air passage having a cross sectional area small enough to inhibit entry of liquid from said container into said air reservoir and large enough to permit free passage of air from said air reservoir, through said liquid, into said container as said liquid is being withdrawn from said container by a suckling.

2. The improvement of claim 1 wherein said container is a baby nursing bottle having an opening to which said nipple is coupled, said insert being interposed between said nipple and said bottle, said insert comprising an annulus having a lip about the periphery thereof for engaging with said bottle at the opening in said bottle;

said annulus having a groove therein, said groove being adjacent said air vent opening in said nipple, said groove being said air reservoir.

3. In a nursing bottle having a necked opening with threads for engaging a threaded closure cap; a nipple having an extended base for coupling contact with said necked opening, said extended base including a central opening through which liquid enters said nipple from said bottle and an air vent opening for allowing air to enter into said nursing bottle; and a threaded closure cap having a central opening through which said nipple is passed, and a shoulder for compressingly coupling said extended base of said nipple to said bottle at said necked opening of said bottle, the improvement comprising:

a generally planar venting insert, inserted between said extended base of said nipple and said necked opening of said nursing bottle;

said insert having a first side having a first bearing surface for bearing on said nipple about the periphery of said extended base and a second bearing surface for bearing on said nipple about the periphery of said central opening of said nipple;

said insert having a second side having a third bearing surface for bearing on the periphery of said necked opening of said nursing bottle;

there being between said first and said second bearing surfaces an air reservoir into which air from said air vent opening flows as liquid is drawn off from said bottle through said nipple; and, an air passage coupling said air reservoir to the interior of said bottle;

said air passage free of vent values and having a cross sectional area small enough to inhibit entry of liquid from said bottle into said air reservoir and large enough to permit free passage of air from said reservoir through said liquid into said bottle as said liquid is being withdrawn from said bottle.

4. An air passing annular disk for use with a nipple and cap on a nursing bottle, said annular disk comprising:

a flat peripheral plane surrounding a central opening through which liquid will readily pass;

an air reservoir embedded in said peripheral plane on a first side of said annular disk;

an air escape passage from said air reservoir through said annular disk for allowing air to flow freely from said reservoir and exit on a second side of said annular disk, said air escape passage free of vent values of being of a size selected to prevent passage of liquid through said passage into said air reservoir;

said first side of said annular disk having a first bearing surface about the periphery of said plane, and a second bearing surface about the periphery of said central opening, each said surface being intended for bearing on a portion of a nipple used in conjunction with a nursing bottle and cap;

said second side of said annular disk having a third bearing surface about the periphery of said disk, said third bearing surface being intended for bearing on a portion of a nursing bottle used in conjunction with a nipple and cap.

5. The combination of a nursing bottle, a nipple, a vacuum inhibitor and, means for securing said nipple and said inhibitor to said bottle, said nipple having a circular flange provided with a nipple vent opening said nipple vent opening being sufficiently large for passage of air into said bottle when clear of any liquid contained in said bottle and sufficiently small to block passage of both air and of liquid when liquid in said bottle covers said nipple vent opening;

said circular flange having a central opening for passage of liquid to said nipple from said nursing bottle, said flange having a first contact surface about the periphery of said central opening and a second contact surface about the periphery of said flange;

said nursing bottle having a circular neck defining a central opening through which liquid can pass to and from said bottle, said neck having a peripheral surface to which said second contact surface of said circular flange of said nipple is nominally coupled;

said vacuum inhibitor comprising a generally planar circular disk having a first disk surface and a second disk surface, and having a central opening for passage of liquid therethrough, said first disk surface having a third contact surface about the periphery of said central opening of said disk and a fourth contact surface about the periphery of said disk, said first disk surface also having a recess therein between said third and said fourth contact surfaces, said recess free of vent values and having a disk vent opening therein through said disk, said vent opening being sufficiently small to block passage of liquid therethrough and sufficiently large to permit passage of air therethrough even when covered by liquid;

said means for securing said nipple and said inhibitor to said bottle comprising means for compressively coupling said circular flange of said nipple and said circular disk of said inhibitor to said circular neck of said bottle so that said central openings of said flange, said disk, and said neck of said bottle are generally concentric;

said combination comprising:

said disk of said inhibitor placed on said bottle with said second disk surface in contact with said peripheral surface of said neck of said bottle;

said nipple placed on said disk of said inhibitor with said first contact surface of said flange being in contact with said third contact surface of said disk, and said second contact surface of said flange in contact with said fourth contact surface of said disk, a portion of said flange covering said recess in said disk, said vent opening in said flange communicating air to said recess; and said means for securing said nipple and said inhibitor compressively coupling said nipple and said inhibitor to said neck of said bottle.

* * * * *